United States Patent [19]

Hernandez

[11] Patent Number: 4,637,458

[45] Date of Patent: Jan. 20, 1987

[54] BLOWOUT PREVENTER FOR USE IN COMBINATION WITH A DEEP WELL PUMP

[75] Inventor: Gabriel D. Hernandez, Maracaibo-Edo. Zulia, Venezuela

[73] Assignee: Maraven, S.A., Caracas, Venezuela

[21] Appl. No.: 817,684

[22] Filed: Jan. 10, 1986

[51] Int. Cl.[4] ..... E21B 33/02; E21B 33/06

[52] U.S. Cl. ..... 166/68; 166/84; 403/343; 277/165

[58] Field of Search ..... 166/68, 82, 88, 84, 166/105.6, 106, 303, 371, 372; 277/165, 110, 111; 403/343, 299, 296, 288; 251/1.1–1.3

[56] References Cited

U.S. PATENT DOCUMENTS

| | | | |
|---|---|---|---|
| 3,155,160 | 11/1964 | Craig, Jr. et al. | 166/303 |
| 3,331,609 | 7/1967 | Moran | 277/165 X |
| 4,329,124 | 5/1982 | Pridy | 403/343 X |
| 4,459,060 | 7/1984 | Patterson | 403/343 X |
| 4,496,161 | 1/1985 | Fischer | 277/165 X |

*Primary Examiner*—Stephen J. Novosad
*Assistant Examiner*—David J. Bagnell
*Attorney, Agent, or Firm*—Bachman & LaPointe

[57] ABSTRACT

A blowout preventer for use in combination with a deep well pump during steam injection, comprises a hollow cylindrical nipple having a top and bottom surface and a through cylindrical bore of diameter $D_1$. A cylindrical mandrel is partially received in the cylindrical bore provided in the nipple. The cylindrical mandrel has a first diameter portion of diameter $D_2$, a second diameter portion of diameter $D_3$ and a third diameter portion of diameter $D_4$ wherein $D_2>D_1>D_3>D_4$ such that the first diameter portion abuts the bottom surface of the nipple upon an excess in well head pressure so as to prohibit blowout. An elastically deformable seal is carried on the third diameter portion of the mandrel for sealing the mandrel within the cylindrical bore of the hollow cylindrical nipple, in order to prevent steam leakage during the steam injection process.

11 Claims, 2 Drawing Figures

BLOWOUT PREVENTER FOR USE IN COMBINATION WITH A DEEP WELL PUMP

BACKGROUND OF THE INVENTION

The present invention relates to an improved blowout preventer and, more particularly, an improved blowout preventer for use in combination with deep well pumps for pumping crudes by the injection of steam into the well.

It is quite common when pumping crudes to provide artificial lifting mechanisms. One mechanism commonly used, provides for the injection of steam into the well for aiding the lifting of the heavy crude by the subsurface pump.

When pumping heavy crudes using steam injection, it is necessary to provide a sealing mechanism to prevent leaking of the steam from the well during the injection process. It is highly desirable to provide such a seal without having to remove the rod string from the well. In addition, it is desirable to provide a blowout preventer mechanism in case an inordinate increase in well head pressure occurs during the injection of steam into the well.

Accordingly, it is the principal object of the present invention to provide a blowout preventer for use in combination with a deep well pump for pumping crudes by the injection of steam which seals the well without the requirement of removing the rod string.

It is a particular object of the present invention to provide a blowout preventer as aforesaid which prevents blowout even when an inordinate increase of well head pressure occurs during the injection of steam into the well.

It is a further object of the present invention to provide a blowout preventer as set forth above which is of simple construction and effective in operation.

Further objects and advantages of the present invention will appear hereinbelow.

SUMMARY OF THE INVENTION

In accordance with the present invention the foregoing objects and advantages are readily obtained.

The present invention relates to an improved blowout preventer for use in combination with a deep well pump for pumping crudes by the injection of steam into the well. In accordance with the present invention, a production tube is positioned in a well for forming an annulus between the production tube and the casing tube. A deep well pump is positioned in the production tube for pumping oil from the well up the production tube. An injector is provided for injecting steam down the annulus between the production tube and the casing tube for aiding in lifting the crude oil by the deep well pump. The deep well pump is driven by a rod string which is connected to a polished rod which is driven by a pumping unit. The blowout preventer of the present invention forms the connecting mechanism between the polished rod and the rod string. In accordance with the present invention, the blowout preventer comprises a hollow cylindrical nipple having a top and bottom surface and a through cylindrical bore of diameter $D_1$. A cylindrical mandrel is partially received within the cylindrical bore provided in the nipple. The cylindrical mandrel has a first diameter portion of diameter $D_2$, a second diameter portion of diameter $D_3$ and a third diameter portion of diameter $D_4$ wherein $D_2>D_1>D_3>D_4$ such that the first diameter portion abuts the bottom surface of the nipple upon an excess in well head pressure so as to prohibit blowout. An elastically deformable seal is carried on the third diameter portion of the mandrel. A connector which is received in the cylindrical bore provided in the nipple is connected to the mandrel and is provided with a surface which is adjacent to the elastomeric deformable seal. The polished bar is secured to the connector while the rod string is secured to the mandrel for transmitting motion from the pumping unit to the deep well pump.

By way of the foregoing structure the well head can be sealed without requiring the removal of the rod string. In addition, blowout is prevented in the event an inordinate increase in well head pressure occurs as a result of injecting steam into the well.

DETAILED DESCRIPTION

Figure 1:
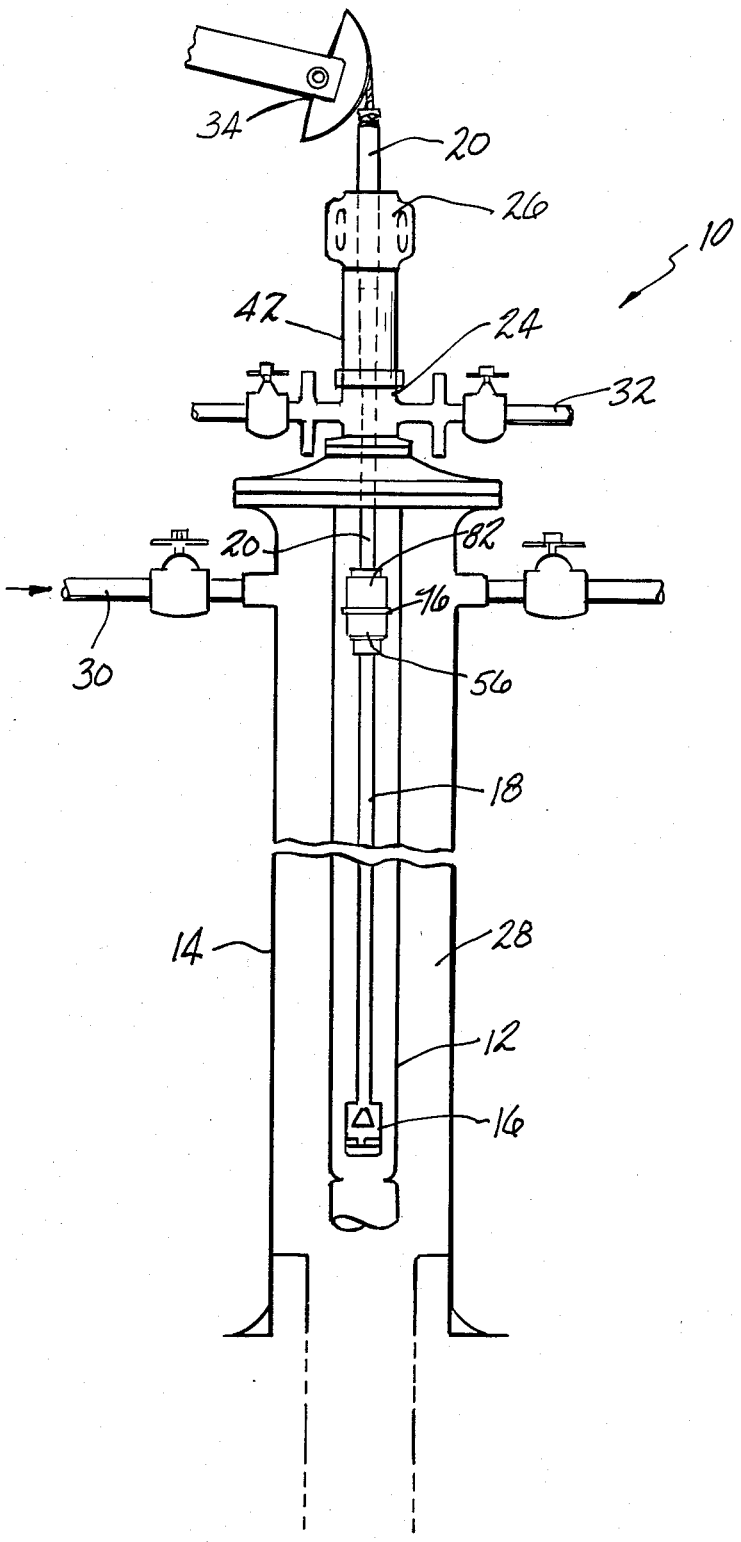
FIG. 1 is a schematic illustration showing a well facility which incorporates the blowout preventer of the present invention.

A well 10 is illustrated having a production tube 12 located within a well bore casing 14. A deep well pump 16 is provided in the production tube 12 and is operated by means of rod string 18. The rod string 18 is connected to polished bar 20 by means of the blowout preventer 22 of the present invention in a manner to be explained hereinbelow. The nipple 42 of blowout preventer 22 is secured to spider 24 and stuffing box 26 on the well head of well 10.

The well bore casing 14 defines with the production tube 12 an annulus 28 which may be supplied with steam via pipe 30. The oil pumped by pump 16 up production tube 12 is removed from the well via pipe 32. Valves are provided in pipes 30 and 32 for selectively connecting the pipes to the annulus 28 and production tube 12, respectively.

The pumping operation is as follows. The pump unit 34 transmits periodic movement to polished bar 20 which passes longitudinally through stuffing box 26 and nipple 42 of blowout preventer 22. This periodic movement of polished bar 20 is transmitted in a manner to be explained hereinbelow to rod string 18 which in turn transmits the periodic movement to the subsurface pump 16 which produces the pumping action by means of a plunger and check valves in a manner well known.

Figure 2:
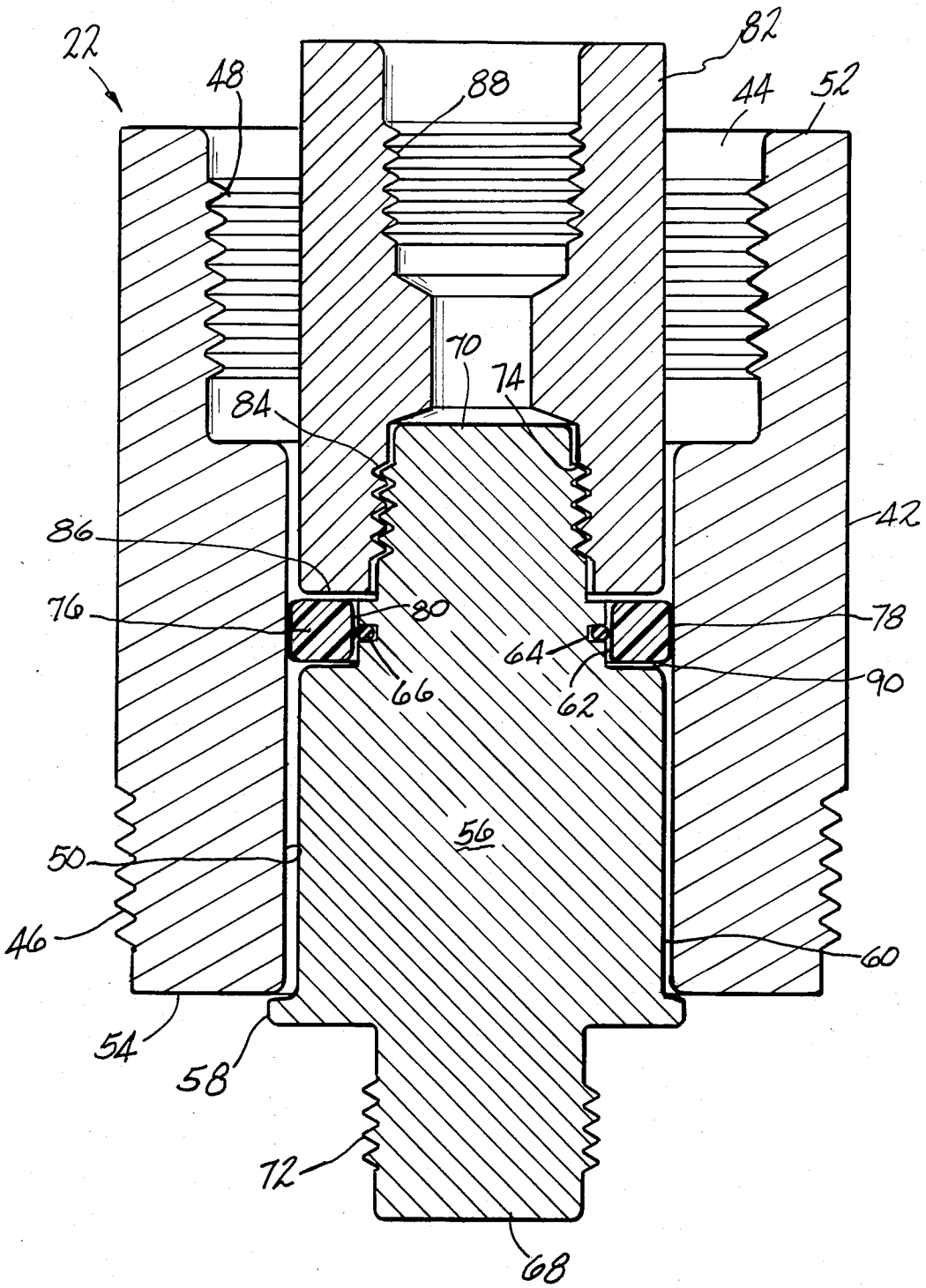
FIG. 2 is a sectional view of the parts which form the blowout preventer in accordance with the present invention when in its operative position.

With reference to FIG. 2 the details of the blowout preventer of the present invention will be discussed. The blowout preventer 22 comprises a hollow cylindrical nipple member 42 having a cylindrical bore 44 provided therein. Nipple 42 is provided at the bottom surface thereof with an external screw thread 46 for securing the nipple to the spider 24 of the well casing. The top surface of the nipple is provided with another threaded portion 48 for connecting the nipple to the stuffing box 26 of the well casing. While the thread 48 is shown to be an internal thread, it should be appreciated that the thread can also be located on the external surface of the nipple 42. Cylindrical bore 44 of nipple 42 has an inside diameter 50 over at least a portion thereof of diameter $D_1$. The nipple 42 is provided with a top surface 52 and a bottom surface 54.

Rod string 18 is connected to polished bar 20 by means of a cylindrical mandrel 56 and a connector 82 which forms with nipple 42 the blowout preventer 22. Cylindrical mandrel 56 has a first diameter portion 58 of diameter $D_2$, a second cylindrical portion 60 of diameter $D_3$ and a third cylindrical portion 62 of diameter $D_4$ wherein $D_2 > D_1 > D_3 > D_4$. Portion 62 is provided with an annular groove 64 on the circumferential surface thereof which receives an elastomeric seal 66 preferably in the form of an O-ring seal. Threaded portions 68 and 70 project from the ends of the first and third diameter portions of cylindrical mandrel 56. External threads 72 and 74 are provided on the projections 68 and 70, respectively. It should be appreciated however that elements 68 and 70 could be provided with female threads if so desired. A ring 76 is received over the third diameter portion 62 of mandrel 56. The ring 76 is made of an elastically deformable material and has an outside diameter 78 which is slightly greater than the inside diameter 50 of cylindrical bore 44 which consists of a polished internal surface with the finish of 12 to 20 micro inches. The inside diameter 80 of ring 76 is slightly greater than the diameter of third cylindrical portion 62. Connector 82 having female thread 84 is threadably received by thread 74 of portion 70 of mandrel 56 such that the lower surface 86 of connector 82 is adjacent ring 76. As noted above portion 70 of mandrel 56 could be provided with a female thread in which case connector 82 would be provided with a male thread. Portion 68 of mandrel 56 is connected to rod string 18 by means of the thread 72 while the polished bar 20 is connected to connector 82 by means of threads 88.

In accordance with the present invention as set forth in FIGS. 1 and 2, the polished bar 20 is joined to the threaded portion 88 of connector 82. The connector 82 in turn is joined to the mandrel 56 by means of threaded connection 84 provided on connector 82 and threaded connection 74 provided on mandrel 56. The mandrel 56 is joined in turn to the rod string 18 by means of threaded portion 72 provided on portion 68. The O-ring seal 66 is situated in circumferential groove 64 in the mandrel 56 while at the same time the ring 76 is held captively laterally between bottom face 86 of connector 82 and the top face 90 of mandrel 56 about third diameter portion 62.

The blowout preventer of the present invention functions as follows. During the pumping operation the pumping unit 34 transmits a periodic movement to the polished bar 20 which passes longitudinally through stuffing box 26 and the nipple 42 of blowout preventer 22. This periodic movement is transmitted to connector 82 and mandrel 56 which in turn transmits the periodic movement to the rod string 18 which finally operates subsurface pump 16 which produces a pumping action by means of a piston and check valves in known manner.

When the injection of steam is to be started into the annulus 28 via line 30 or through production tube 12 via line 32, the polished bar 20 is raised together with the rod string 18, thus unseating pump 16, until connector 82 and mandrel 56 are drawn into bore 44 of nipple 42 wherein the ring 76 comes into contact with inside diameter 50 of bore 44 of nipple 42. The ring 76 being forced into the nipple 42 forms a seal due to the interference fit as a result of the fact that the outside diameter of the ring 76 is greater than the inside diameter 50 of the bore 44 of nipple 42. At the same time, as the ring 76 is elastically deformed such that the interior diameter 80 of the ring 76 compresses the O-ring 66 to likewise form a seal.

Once the polished rod 20 has been tensioned, it is fastened by any known manner so that it will not move during the injection of steam into the well. The tension applied to polished bar 20 for the purposes of seating ring 76 inside the nipple 42 must be less than the weight of the rod string 18 and subsurface pump 16.

When the injection of steam is started, the steam will not be able to leak from the casing head due to the action of the seals formed by the outer face of the ring 76 with the polished surface 50 of the nipple 42 and the inside surface 80 of the ring 76 as it deforms the O-ring 66 which is held captive in circumferential groove 64 of the third diameter portion 62 of mandrel 56.

Once the injection of steam has been completed the fastening applied to the polished bar 20 is released and the dead weight of the rod string 18 and the pump 16 assures that the assembly comprising connector 82, the mandrel 56 and the ring 76 and O-ring seal 66 are lowered and separated from the nipple 42 thus breaking the seal which existed during the injection of steam. Once the subsurface pump 16 has been seated through the dead weight of the rod string 18 and the pump itself, the polished bar 20 is connected to the pumping unit 34. At first, the production of crude oil usually commences by natural flow due to the increased bottom pressure provided by the steam injection process; but after a short length of time, the natural flow ends, since the bottom pressure drops and becomes insufficient to bring the crude oil to the surface. At this time, the pumping unit 34 is turned on, and now the production of crude oil occurs through the pumping action of pump 16.

As it is required to repeat the injection of steam, the above procedure is carried out once again. If the ring 76 or O-ring 66 of elastomeric material should be damaged, they can be quickly replaced by conventional methods well known to those familiar with oil production operations.

If during the injection of steam into the well an inordinate increase of pressure should occur in the well head, the first diameter portion 58 of mandrel 56, the diameter of which is greater than the inside diameter 50 of bore 44 of nipple 42, will be forced against the bottom part 54 of the nipple 42 effecting sealing contact and thus preventing a blowout from occurring.

As a result of the blowout preventer of the present invention a number of advantages are obtained. Injection of steam is permitted into the well without requiring removal of the rod string. There are essentially no moving parts in the blowout preventer and the implementation of the blowout preventer is extremely simple thereby not requiring skilled personnel.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A blowout preventer for use in combination with a deep well pump when pumping crudes by the injection of steam into a well comprising:

(a) production tube means positioned in the well for forming an annulus between said production tube means and the well bore casing of the well;

(b) pump means in the production tube means for pumping oil up the production tube means;
(c) injector means for injecting steam into the well;
(d) a pump unit connected to a polished bar for transmitting motion to said polished bar;
(e) a rod string connected to said pump means; and
(f) a blowout preventer connecting said polished bar to said rod string for transmitting motion from said pumping unit to said pump for pumping oil up the production tube means, said blowout preventer comprising a hollow cylindrical member having a top and a bottom surface and a cylindrical bore of diameter $D_1$, a cylindrical mandrel partially received in said hollow cylindrical bore, said cylindrical mandrel having a first diameter portion $D_2$, a second diameter portion $D_3$ and a third diameter portion $D_4$ wherein $D_3$ is positioned between $D_2$ and $D_4$ and $D_2>D_1>D_3>D_4$ such that said first diameter portion abuts the bottom surface of said hollow cylindrical member upon an inordinate increase of pressure in said well.

2. The combination according to claim 1 wherein an elastically deformable seal is carried on said third diameter portion and a connector member is connected to said mandrel, said connector having a bottom face adjacent said elastically deformable seal wherein said elastically deformable seal seals against said cylindrical bore of diameter $D_1$ of said hollow cylindrical nipple.

3. The combination according to claim 2 wherein said rod string is secured to said mandrel and said polished bar is secured to said connector member.

4. The combination according to claim 2 wherein said third diameter portion is provided with an annular groove on the circumferential surface which receives an elastomeric seal which seals against said elastically deformable seal.

5. The combination according to claim 1 including injector means for injecting stem down said annulus.

6. The combination according to claim 1 including injector means for injecting steam through said production tube.

7. A blowout preventer for use in combination with a deep well pump when pumping crudes by the injection of steam into a well comprising:

(a) production tube means positioned in the well for forming an annulus between said production tube means and the well bore casing of the well;
(b) pump means in the production tube means for pumping oil up the production tube means;
(c) injector means for injecting steam down said annulus;
(d) a pump unit connected to a polished bar for transmitting motion to said polished bar;
(e) a rod string connected to said pump means; and
(f) a blowout preventer connecting said polished bar to said rod string for transmitting motion from said pumping unit to said pump for pumping oil up the production tube means, said blowout preventer comprising a hollow cylindrical nipple having a cylindrical bore, a mandrel partially received in said bore of said hollow cylindrical nipple and an elastically deformable seal carried on said mandrel for sealing said mandrel in said bore of said hollow cylindrical nipple.

8. A coupling assembly for connecting a polished bar and rod string of a deep well pump comprising a hollow cylindrical nipple having a top and a bottom surface and a cylindrical bore of diameter $D_1$, a cylindrical mandrel partially received in said hollow cylindrical bore, said cylindrical mandrel having a first diameter portion $D_2$, a second diameter portion $D_3$ and a third diameter portion $D_4$ wherein $D_3$ is positioned between $D_2$ and $D_4$ and $D_2>D_1>D_3>D_4$ such that said first diameter portion abuts the bottom surface of said nipple upon an inordinate increase of pressure in said well.

9. An assembly according to claim 8 wherein an elastically deformable seal is carried on said third diameter portion and a connector member is connected to said mandrel, said connector having a bottom face adjacent said elastically deformable seal wherein said elastically deformable seal seals against said cylindrical bore of diameter $D_1$ of said hollow cylindrical nipple.

10. An assembly according to claim 9 wherein said rod string is secured to said mandrel and said polished bar is secured to said connector member.

11. An assembly according to claim 9 wherein said third diameter portion is provided with an annular groove on the circumferential surface which receives an elastomeric seal which seals against said elastically deformable seal.

* * * * *